US005535711A

United States Patent [19]

Kach

[11] Patent Number: 5,535,711

[45] Date of Patent: Jul. 16, 1996

[54] TEMPERATURE CONTROLLING APPARATUS FOR ENGINE, TRANSMISSION, AND HYDRAULIC FLUIDS

[75] Inventor: Edwin A. Kach, Chillicothe, Ill.

[73] Assignee: Caterpillar Inc., Peoria, Ill.

[21] Appl. No.: 501,348

[22] Filed: Jul. 12, 1995

[51] Int. Cl.[6] ..... F01M 5/00

[52] U.S. Cl. ..... 123/142.5 R; 123/196 AB

[58] Field of Search ..... 123/142.5 R, 196 AB

[56] References Cited

U.S. PATENT DOCUMENTS

| | | | |
|---|---|---|---|
| 1,958,156 | 5/1934 | Whelan | 123/196 AB |
| 1,989,585 | 1/1935 | Bigelow | 123/196 AB |
| 2,290,300 | 7/1942 | Spackman | 123/196 AB |
| 2,400,977 | 5/1946 | Clarkson | 123/142.5 R |
| 2,405,144 | 8/1946 | Holthouse | 123/142.5 R |
| 4,442,819 | 4/1984 | Veach | 123/196 AB |
| 5,048,753 | 9/1991 | Kellie | 123/142.5 R |

FOREIGN PATENT DOCUMENTS

| | | | |
|---|---|---|---|
| 634565 | 1/1995 | European Pat. Off. | 123/196 AB |
| 2123360 | 11/1971 | Germany | 123/142.5 R |
| 2745931 | 4/1978 | Germany | 123/196 AB |
| 3142327 | 5/1983 | Germany | 123/196 AB |
| 475021 | 2/1972 | Japan | 123/196 AB |
| 696174 | 11/1979 | U.S.S.R. | 123/142.5 R |

*Primary Examiner*—Erick R. Solis
*Attorney, Agent, or Firm*—Frank L. Hart; Alan J. Hickman

[57] ABSTRACT

A temperature controlling apparatus is adapted for association with preselected fluid systems of an internal combustion engine expected to be used in extremely cold atmospheres. The apparatus has a heater associated with a heat transfer reservoir which surrounds the fluid reservoir of the engine desired to be heated.

6 Claims, 4 Drawing Sheets

TEMPERATURE CONTROLLING APPARATUS FOR ENGINE, TRANSMISSION, AND HYDRAULIC FLUIDS

TECHNICAL FIELD

The present invention relates to an apparatus for controlling the temperature of fluids of or associated with an internal combustion engine. More particularly, this invention relates to heating preselected fluids of an internal combustion engine expected to be used in extremely cold atmospheres.

BACKGROUND ART

Various constructions have been developed for cooling preselected fluids of or associated with an internal combustion engine. The art that has been discovered generally resides in engines that are utilized on highways and often are not of a construction adapted for massive off-highway work machines.

When engines are utilized in the arctic, or other extremely cold environments, there are considerable problems associated with maintaining the engines and their associated fluids at temperatures which promote efficient operation. This is particularly true where an engine has remained in such harsh conditions without being operated for a considerable period of time.

Fluid reservoirs are often constructed of thin wall metal. This results in a structure that readily resonates when excited by harmonic vibrations resulting from engine or transmission operation and the generation of undesirable noise.

The present invention is directed to overcome one or more of the problems as set forth above.

DISCLOSURE OF THE INVENTION

A temperature controlling apparatus is provided for association with preselected fluid systems of or associated with an internal combustion engine expected to be used in extremely cold atmospheres. The engine has a lubricating oil reservoir defined by a first housing. A second housing has an inlet, an outlet and is fixedly positioned about the first housing, spaced from and integral with the first housing and defines therewith a heat transfer reservoir. A fuel fired heater is connectable to the inlet and outlet of the second housing. A pump is connected to the heater, is in communication with the heat transfer reservoir and is adapted to move heat transfer medium from the heat transfer reservoir, through the heater and back to the heat transfer reservoir. The heater and pump define a heater-pump circuit.

BEST MODE FOR CARRYING OUT THE INVENTION

Figure 1:
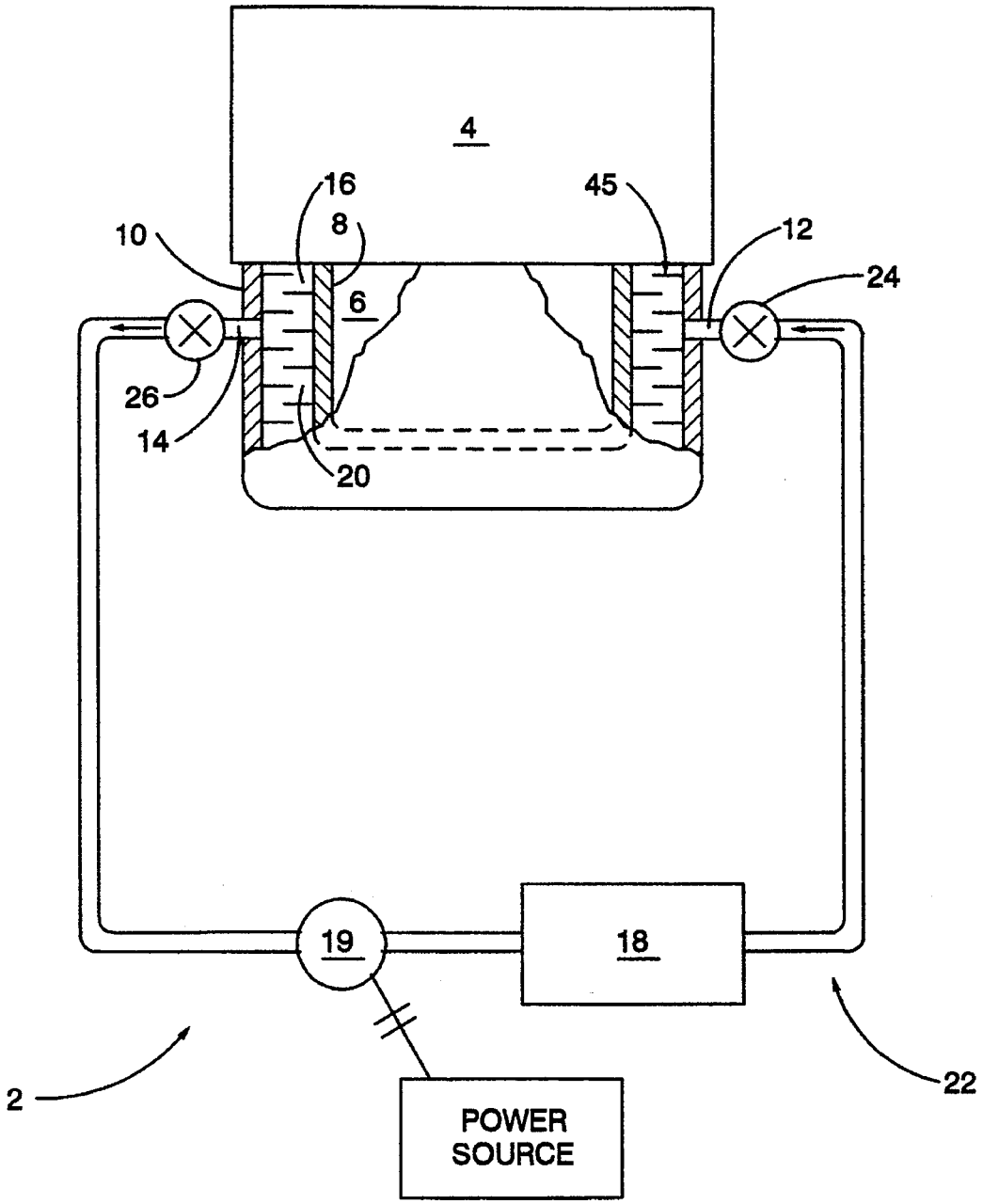
FIG. 1 is a diagrammatic view of the apparatus of this invention connected to a preselected fluid reservoir of or associated with an engine.

Referring to FIG. 1, a temperature controlling apparatus 2 of this invention is adapted for association with preselected fluid systems of an internal combustion engine 4 that is expected to be used in extremely cold atmospheres, as for example, the arctic. The engine 4 has a lubricating oil reservoir 6 defined by a portion of the engine 6 and a first housing 8, as is well known in the art.

A second housing 10 is provided which has an inlet 12, an outlet 14 and is fixedly positioned about the first housing 8, is spaced from and integral with the first housing 8, and defines a heat transfer reservoir 16. The first and second reservoirs 6,16 are not in communication with one another, but are in heat exchange relationship via the first housing 8.

A heater 18, preferably a fuel fired heater, is connectable to the inlet 12 and outlet 14 of the second housing 10 and in communication with the heat transfer reservoir 16. A pump 19 is connected to the heater 18, in communication with the heat transfer reservoir 16, and is adapted to move heat transfer medium 20 from the heat transfer reservoir 16, through the heater 18 and back into the heat transfer reservoir 16. For brevity of description, the heater 18, the pump 19 and associated pipe connections will hereafter be referred to in combination as a heater-pump circuit.

It is preferred that the heating medium 20 associated with the lubricating oil reservoir 6 be of a type compatible with the fluid contained in the reservoir 6 so that if accidental mixing occurs, no damage will result. For example, it is preferred that the heating medium 20 associated with the engine lubricating oil reservoir 6 be synthetic engine lubricating oil. Also acceptable is, for example, commonly used coolant mixes such as glycol and water.

In an embodiment desirable in some machines or operations, the apparatus of this invention is not permanently attached to the machine, such as a crawler tractor. In such construction, first and second valves 24,26 are each respectively connected to the second housing inlet 12 and outlet 14 in the heater-pump circuit 22. These valves are provided for terminating communication of the heater 18 and pump 19 with the heat transfer reservoir 16. Upon termination, the heater-pump circuit can be removed from the machine.

Figure 2:
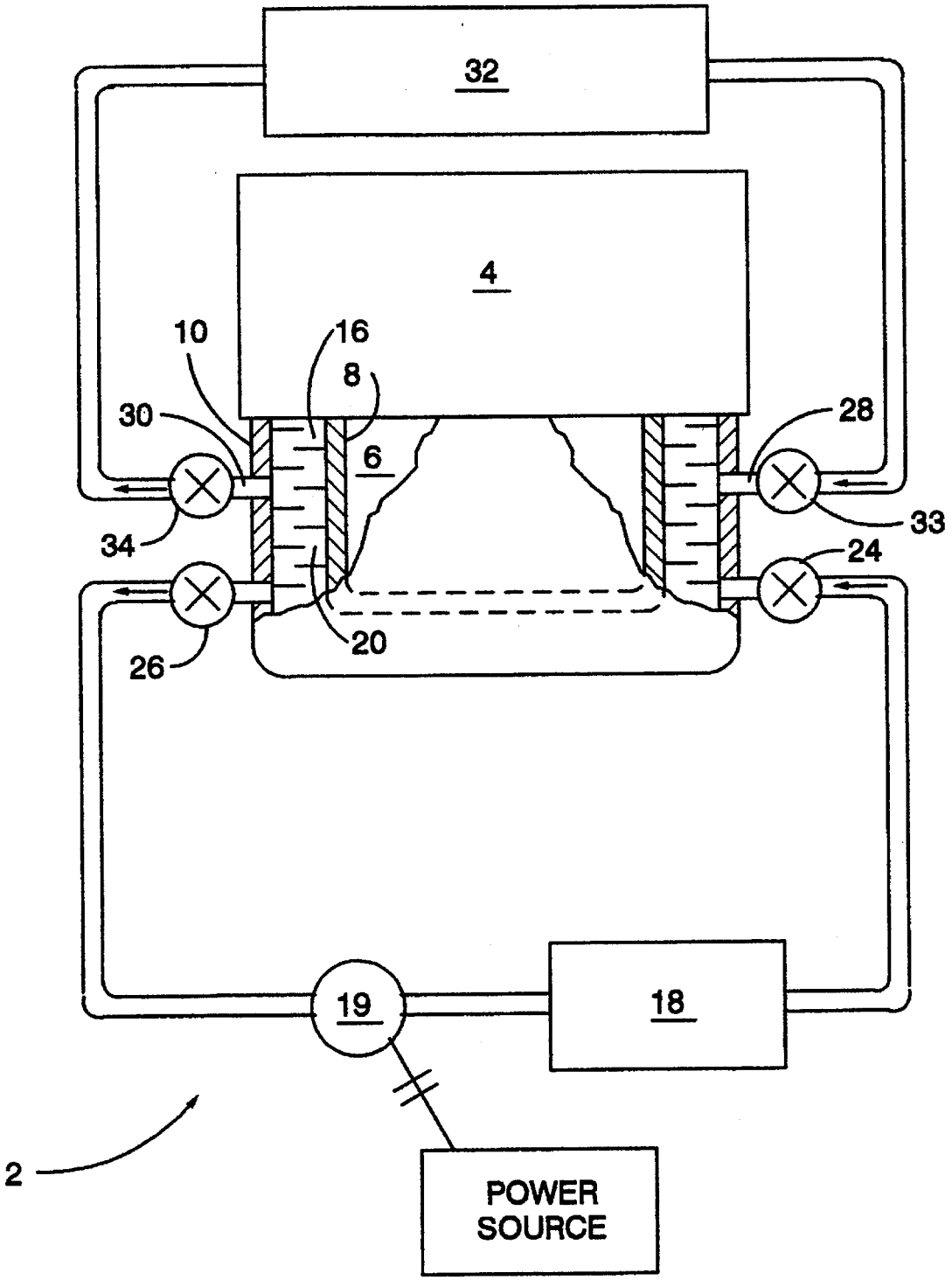
FIG. 2 is a diagrammatic view of the apparatus of this invention of FIG. 1 having an additional temperature controlling system connected thereto.

Referring to FIG. 2, the system described in FIG. 1 can be further enhanced to provide different advantageous features. In the embodiment shown in FIG. 2, a second inlet 28 and a second outlet 30 are each connected in fluid communication with the heat transfer reservoir 16 and with an engine coolant reservoir 32, such as a cab heater. Valves 28,30 can be provided for isolating the engine coolant reservoir 32 from the heater-pump circuit during heating operation and can thereafter place engine coolant in communication with the heat transfer reservoir 16 during operation of the vehicle when the heater-pump circuit is disabled or removed. It should be understood, however, that valve 33,34 are not essential and the engine coolant reservoir can be connected directly to and in constant communication with the heat transfer reservoir 16.

Figure 3:
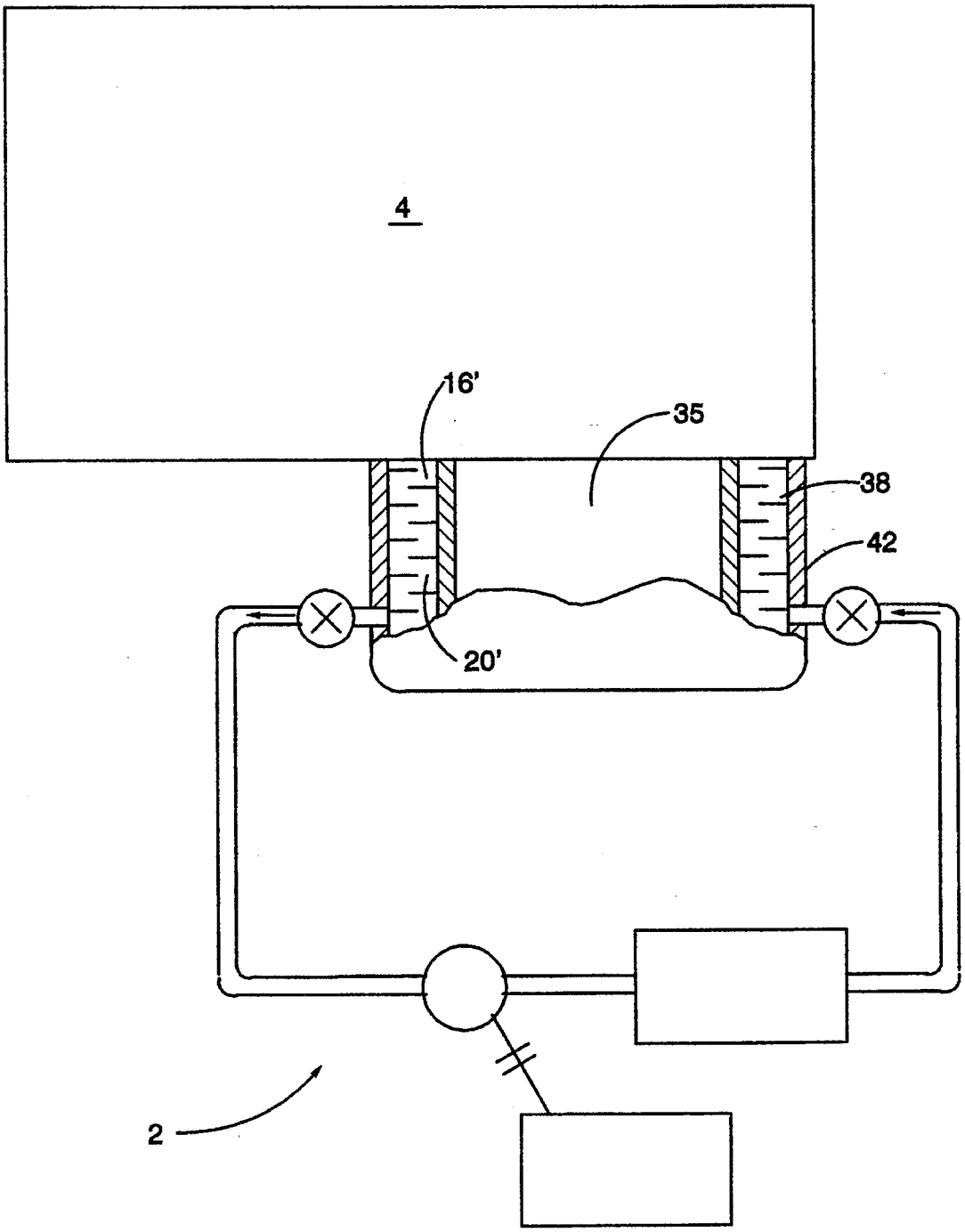
FIG. 3 is a diagrammatic view of the apparatus of this invention connected to a preselected other fluid reservoir of the engine.
Figure 4:
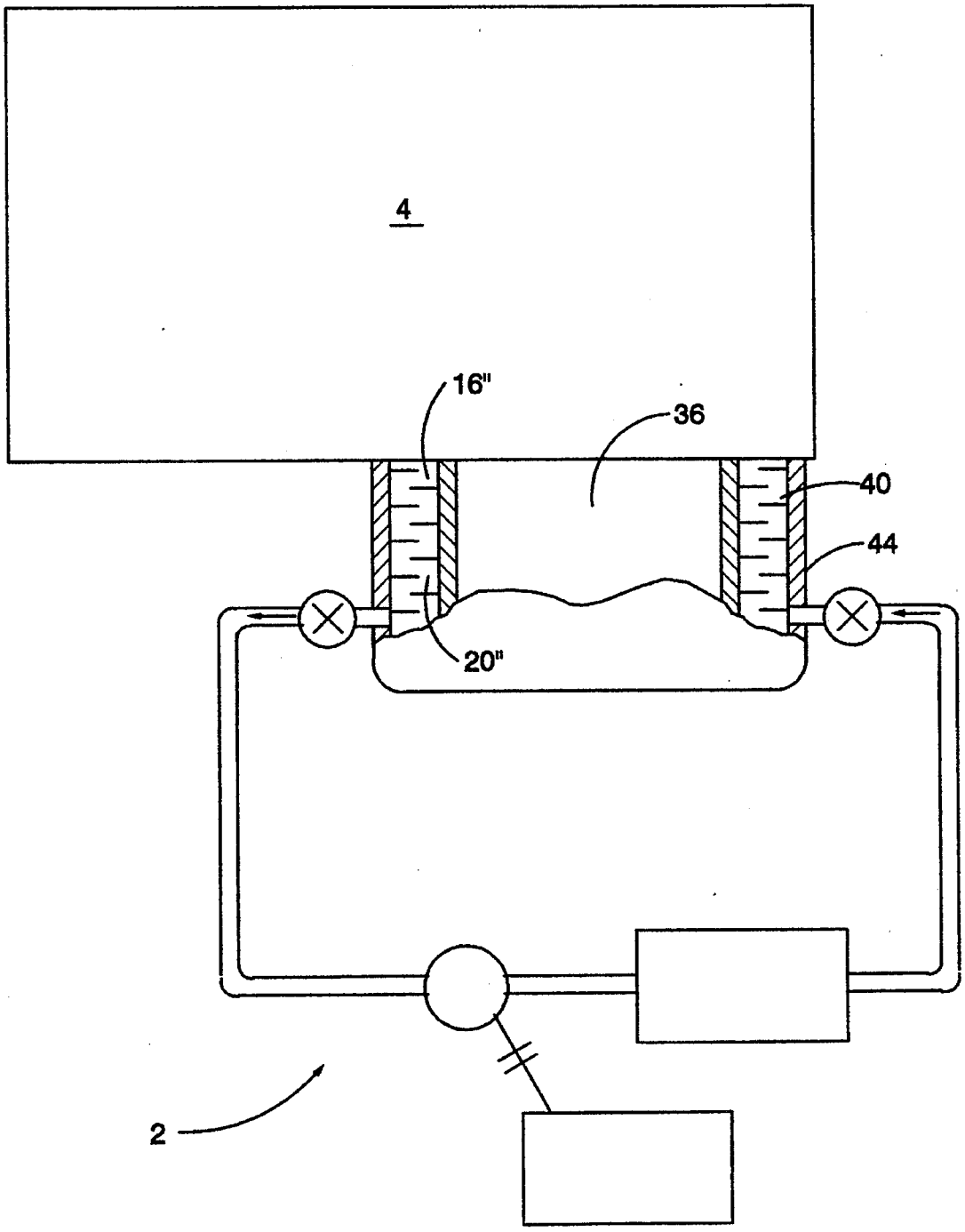
FIG. 4 is a diagrammatic view of the apparatus of this invention connected to yet another preselected fluid reservoir of the engine.

Referring to FIGS. 3 and 4, other fluid reservoirs of the engine 4, such as the transmission fluid reservoir 35 (FIG. 3) and the hydraulic fluid reservoir 36 (FIG. 4) can respectfully have a heat transfer reservoir 38,40 connectable to and associated with the heater-pump circuit 22 of this invention. The respective heat transfer reservoirs 38,40 are defined by a portion of the engine and a transmission fluid housing 42 and a hydraulic fluid housing 44. As set forth above, the heat transfer media 20', 20" of reservoirs 38,40 are preferably compatible with the fluid of their associated reservoirs 35,36. For example, it is preferred that the heat transfer media 16' of the transmission fluid reservoir 35, be synthetic transmission oil and the heat transfer media 16" of the hydraulic fluid reservoir 36 be synthetic hydraulic oil. However, it should be understood that other heat transfer medium and other fluid systems can be controlled by the apparatus of this invention without departing therefrom.

The heater 18 is preferably a fuel fired heater for purposes of convenience, but can be powered by other means without departing from this invention. As is known in the art, the pump 19 can be powered by various systems, preferably electrical.

A turbulator 45 and/or metal heat transfer elements can be positioned within the heat transfer reservoirs 16,16',16" to enhance the transfer of heat. Such elements are well known in the art and can be of various construction and configuration.

INDUSTRIAL APPLICABILITY

In the operation of the apparatus of this invention, the heater-pump circuit 22 of FIG. 1 can be connected to the heat transfer reservoir 16 of the lubricating oil reservoir 6, or to the reservoir 16' associated with the transmission fluid reservoir 35 or to the reservoir 16" associated with the hydraulic fluid reservoir 36 or to combinations thereof.

Valves 24,26 are opened and the heater 18 and pump 19 are actuated. Heating media flowing through the circuit is heated, passed into the heat transfer reservoir 16/16'/16" which heats the walls and the associated lubricating oil, transmission fluid, or hydraulic fluid.

Upon reaching an elevated optimum temperature, the engine can be started and/or the associated engine elements can be operated with reduced waste of power, materials and wear on the machine.

Referring to FIG. 2, once the engine is operating, valves 33,34 can be opened and the engine coolant can function to continue to heat the heat transfer media and or maintain the temperature of the media. This communication also functions to maintain the lubricating oil in a considerably less viscous state long after the engine has been shut down.

Other aspects, objects and advantages of this invention can be obtained from a study of the drawings, the disclosure and the appended claims.

I claim:

1. A temperature controlling apparatus adapted for association with preselected fluid systems of and associated with an internal combustion engine expected to be used in extremely cold atmospheres, comprising:

said engine having a lubricating oil reservoir defined by a first housing;

a second housing having an inlet, an outlet and being fixedly positioned about the first housing, spaced from and integral with said first housing and defining a heat transfer reservoir;

a heater connectable to the inlet and outlet of the second housing; and a pump connected to the heater, in communication with the heat transfer reservoir, and adapted to move heat transfer medium from the heat transfer reservoir, through the heater and back to the heat transfer reservoir, said heater and pump defining a heater-pump circuit; and first and second valves each respectively connected to the second housing inlet and outlet in the heater-pump circuit, said first and second valves each being selectively movable between fluid passing and fluid blocking positions, said first and second valves blocking the passing of fluid flow from the second housing and in the heater-pump circuit at the fluid blocking positioning and optionally permitting removal of the heater pump circuit from connection with the second housing.

2. An apparatus, as set forth in claim 1, wherein said engine includes an engine coolant reservoir and wherein said heat transfer reservoir has a second inlet and a second outlet each connected in fluid communication with the engine coolant reservoir.

3. An apparatus, as set forth in claim 2, including third and fourth valves each respectively connected to the second inlet and second outlet of the second housing and to the engine coolant reservoir and being adapted for initiating and terminating communication of the engine coolant reservoir with the heat transfer reservoir.

4. An apparatus, as set forth in claim 1, wherein said engine has a transmission fluid reservoir defined by a transmission fluid housing;

a second transmission fluid housing having an inlet, an outlet and being fixedly positioned about the transmission fluid housing, spaced from and integral with said transmission fluid housing and defining a transmission heat transfer reservoir; and said heater-pump circuit being connectable to the transmission heat transfer inlet and outlet.

5. An apparatus, as set forth in claim 4, wherein said engine has a hydraulic fluid reservoir defined by a hydraulic fluid housing;

a second hydraulic fluid housing having an inlet, an outlet and being fixedly positioned about the hydraulic fluid housing, spaced from and integral with said hydraulic fluid housing and defining a hydraulic heat transfer reservoir; and said heater-pump circuit being connectable to the hydraulic heat transfer housing inlet and outlet.

6. An apparatus, as set forth in claim 1, wherein said engine has a hydraulic fluid reservoir defined by a hydraulic fluid housing;

a second hydraulic fluid housing having an inlet, an outlet and being fixedly positioned about the hydraulic fluid housing, spaced from and integral with said hydraulic fluid housing and defining a hydraulic heat transfer reservoir; and said heater-pump circuit being connectable to the hydraulic heat transfer housing inlet and outlet.

* * * * *